US007387463B2

(12) United States Patent
Winn, Jr.

(10) Patent No.: US 7,387,463 B2
(45) Date of Patent: Jun. 17, 2008

(54) MANHOLE COVER REMOVAL APPARATUS AND METHOD OF USE

(76) Inventor: Walter T. Winn, Jr., P.O. Box 2727, Longview, TX (US) 75606

( * ) Notice: Subject to any disclaimer, the term of this patent is extended or adjusted under 35 U.S.C. 154(b) by 195 days.

(21) Appl. No.: 11/320,505

(22) Filed: Dec. 27, 2005

(65) Prior Publication Data

US 2006/0177266 A1 Aug. 10, 2006

Related U.S. Application Data

(60) Provisional application No. 60/639,841, filed on Dec. 28, 2004.

(51) Int. Cl.
*B66F 3/00* (2006.01)

(52) U.S. Cl. ..... 404/73; 254/11; 414/756

(58) Field of Classification Search ..... 404/25, 404/26, 73; 254/11, 131; 414/756
See application file for complete search history.

(56) References Cited

U.S. PATENT DOCUMENTS 3,861,649 A * 1/1975 Mosley ..... 254/124
4,662,607 A * 5/1987 Mochizuki et al. ..... 254/131
4,746,098 A * 5/1988 Abarotin ..... 254/130
4,991,893 A * 2/1991 Gordon et al. ..... 294/17
5,035,336 A * 7/1991 Schmitz et al. ..... 212/166
5,775,674 A * 7/1998 Bigham ..... 254/131
5,993,106 A * 11/1999 Huang ..... 404/26
6,554,254 B2 * 4/2003 Vetesnik ..... 254/325
6,609,742 B1 * 8/2003 Macom et al. ..... 294/82.13
6,945,742 B2 * 9/2005 Roberts ..... 414/449

* cited by examiner

*Primary Examiner*—Gary S Hartmann
(74) *Attorney, Agent, or Firm*—Ronald B. Sefrna

(57) ABSTRACT

An apparatus for separating and lifting a manhole cover from a cover mounting ring without disturbing the mounting ring includes a body, a lever arm and lifting arm pivotally connected to the body with the outer end of the lifting arm extending outwardly from the first end of the body, an preferably hydraulic actuator for raising and lowering the outer end of the lifting arm, and a ring engagement plate extending outwardly from the first end of the body below the lifting arm, to be received over the cover mounting ring. The apparatus may be constructed by modifying a conventional hydraulic floor jack. Upon activation of the hydraulic actuator lifting force is imposed between the cover and the cover mounting ring to separate and lift the cover without disturbing the mounting ring.

19 Claims, 7 Drawing Sheets

MANHOLE COVER REMOVAL APPARATUS AND METHOD OF USE

RELATED APPLICATION DATA

This application claims the benefit of U.S. provisional patent application Ser. No. 60/639,841, filed Dec. 28, 2004, and titled "Manhole Cover Removal Apparatus".

FIELD OF THE INVENTION

The present invention generally relates to the field of devices and apparatus for lifting and moving manhole covers and grates, and in its preferred embodiments more specifically relates to an apparatus for separating a manhole cover from the cover mounting ring and removing the manhole cover without disturbing the mounting ring.

BACKGROUND OF THE INVENTION

It is very common, especially in cities and municipalities, as well as in industrial settings, for various types of utilities to be routed underground, and accessed through manholes extending downward from, e.g., the surface of a street or other paved or unpaved area to the utility zone. Manholes, which are typically cylindrical shafts or enclosures are formed of a variety of materials such as brick or concrete, but are fairly uniformly capped by a mounting ring that fits onto the top of the manhole and a manhole cover that fits into the ring. Manhole covers are typically formed of metal, although other materials can be used, and are normally very substantial and heavy, so that they will withstand the weight of vehicles passing over them, and will discourage casual removal by unauthorized persons. However, the manhole covers must be removed whenever it is necessary to gain access to the manhole, and the size and weight of the covers can make this a difficult process.

Workers often encounter another problem with removal of manhole covers, in addition to their weight. It is common for manhole covers to become adhered to or jammed into the mounting rings, as a result of a variety of factors or combination of factors, including the weight of vehicles traveling over them, corrosion, dirt and debris, and the intrusion of paving materials between the cover and ring. In that situation, applying lifting force to the manhole cover itself can pull the ring away from the manhole structure along with the cover. When that occurs the cover must be refitted to the manhole, grouted in place, and, often, any paving around the cover must be repaired, which can be a time consuming and costly procedure.

Various types of devices and apparatus for lifting and moving manhole covers are known in the prior art, ranging from simple mechanical lever devices to complex vehicle mounted electromagnetic apparatus. Although the devices and apparatus of the prior art are reasonably effective in applying a lifting force for the manhole cover, the prior art has not effectively addressed the problem of lifting and removing a manhole cover without disturbing the mounting ring.

SUMMARY OF THE INVENTION

The present invention provides an apparatus that is very effective for lifting and moving a manhole cover without substantial physical exertion, while assuring that the mounting ring remains undisturbed and is not lifted with the manhole cover. In the preferred embodiments the apparatus of the invention includes a body, a lever arm pivotally connected to the body, a lifting arm connected to the lever arm and extending outwardly from one end of the body. An actuating means, such as a hydraulic cylinder and piston assembly is connected between the body and one end of the lever arm, so that activation of the actuating means causes the lever arm to rotate, raising and lowering the lifting arm. A ring engagement plate extends outwardly from the body below the lifting arm, to be received on the mounting ring without extending over any portion of the cover itself. A releasable connection is made between the outer end of the lifting arm and the cover to be separated and lifted from the mounting ring. The lifting force imposed upon activation of the actuating means acts between the cover and the mounting ring to separate the cover from the mounting ring without disturbing the mounting ring.

The structure and features, and the method of use of preferred and certain alternative embodiments of the apparatus of the invention will be described in detail with reference to the accompanying drawing figures.

DESCRIPTION OF THE INVENTION

Figure 1:
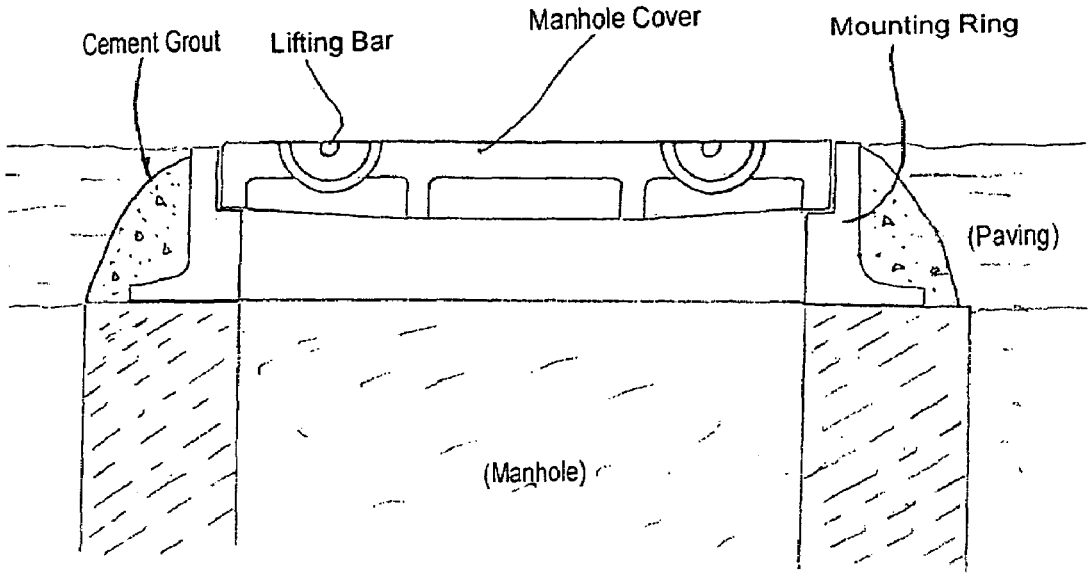
FIG. 1 is a cut-away side elevation view of a typical manhole cover and ring in place on a manhole, shown to establish the context in which the apparatus of the invention is intended to be used.

FIG. 1 shows a typical structure and placement of a manhole cover and ring over a manhole, to illustrate a context in which the apparatus of the invention may be used, and the problems that can occur if the ring is disturbed when the manhole cover is removed. A manhole cover is typically formed as a generally planar circular disk. The upper surface may be flat or may include low ridges for traction. A typical manhole cover includes at least one lifting bar extending across a shallow cavity in the cover, to be engaged with a lifting tool. In some manhole cover designs a slotted opening through the cover is engaged by inserting an "L-shaped" or "T-shaped" tool and turning it to engage the lower surface of the manhole cover for lifting. As can be seen from the illustration, the mounting ring typically includes a flange that extends outwardly from the base or lower edge of the ring. The manhole cover fits into a circumferential notch formed in the upper edge of the ring, so that the outer portion of the upper edge of the ring is exposed and at generally the same elevation as the upper surface of the manhole cover. The flange at the base of the ring supports the ring on the manhole structure. Cement grout is used to loosely attach the ring to the wall of the manhole. Paving material for the street or other surface in which the manhole is placed extends over the grout and flange and to the upper edge of the mounting ring, so that the manhole cover and the upper edge of the mounting ring are at generally the same elevation as the surrounding pavement. It can be seen, then, that if the manhole cover does not readily separate from the mounting ring, the application of lifting force to the manhole cover can resulting in pulling the ring flange away from the manhole structure and breaking through the surface surrounding the mounting ring. The apparatus of the invention effectively addresses this problem.

In its preferred embodiment the apparatus of the invention, generally identified by reference number 10, includes a generally hollow body 11 with a first end 12, a second end 13, a first side 14, and a second side 15. A hydraulic cylinder and piston assembly 16 is disposed and connected in the interior of the body adjacent to the second end 13, with the piston 17 extending from the cylinder of the assembly toward the first end of the body. The hydraulic cylinder and piston assembly is preferably manually operated by handle 18. An elongate lever arm 19 is pivotally connected between the first and second sides 14 and 15, respectively, of body 11, preferably by a pivot pin 20 extending through aligned apertures in the sides of the body and the lever arm. The first end 21 of lever arm 19 is pivotally connected to the outer end of piston 17, so that extension of piston 17 from the hydraulic cylinder will force the first end of the lever arm toward the first end of the body of the apparatus, rotating the lever arm and raising the second end 22 of the lever arm from the body.

The structure described above is essentially that of a conventional floor jack, and a conventional floor jack, with additional components and modifications described below, may be used within the scope of the invention to provide the lifting force for removing a manhole cover from the mounting ring. Floor jacks may be obtained fairly economically, and the use of a floor jack simplifies the construction process as well as simplifying maintenance and repair, since replacement parts are readily available.

Figure 2:
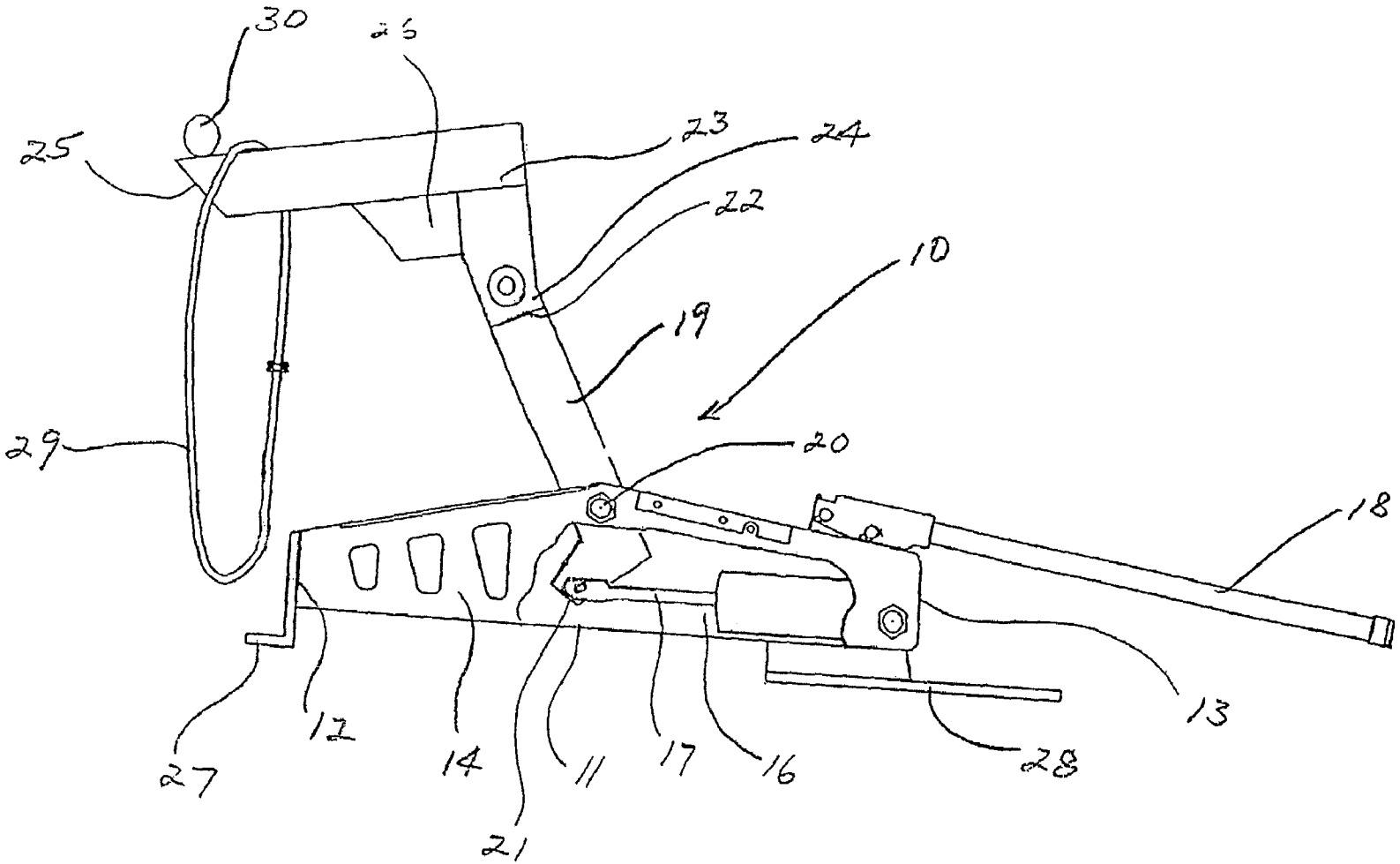
FIG. 2 is a partially cut-away side elevation view of a preferred embodiment of the apparatus of the invention, independently constructed.
Figure 3:
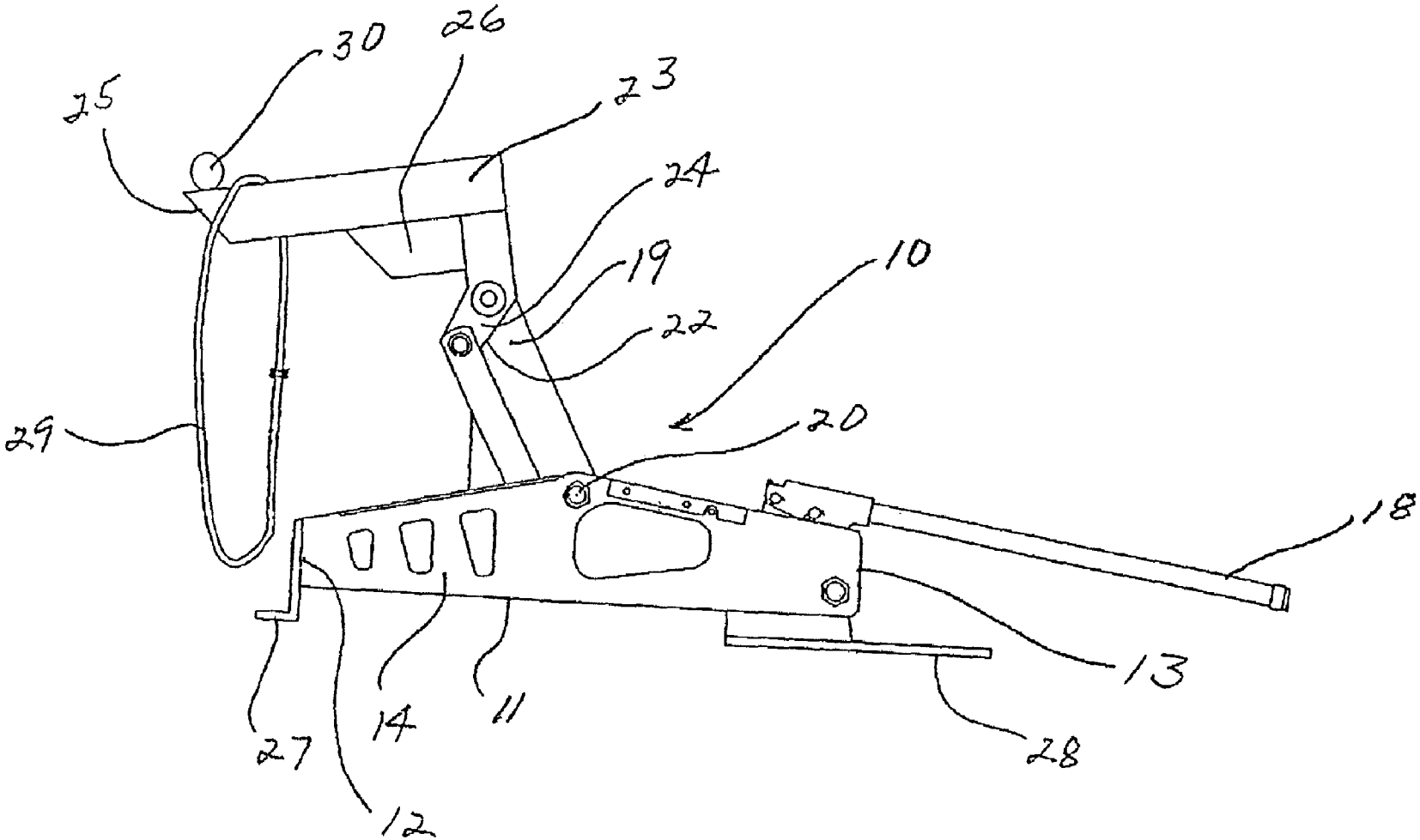
FIG. 3 is a side elevation view of a preferred embodiment of the apparatus of the invention in which a conventional floor jack is used to provide lifting force.

An elongate lifting arm 23 is connected at its first end 24 to the second end of lever arm 19 and extends at an angle relative to the lever arm outwardly beyond the first end of body 11. It is preferred that the lifting arm be offset from the lever arm to assure that the second, outer end 25 of the lifting arm remains above the surface on which the apparatus rests with hydraulic piston fully retracted and the lever arm fully lowered, to provide working clearance. In the embodiment of the apparatus illustrated in FIG. 2, in which the apparatus is independently constructed, the lifting arm may be formed as a separate component and connected to the lever arm, or the lever arm and the lifting arm may be integrally formed as a single component. FIG. 3 illustrates an embodiment in which a conventional floor jack is modified to provide the lifting force for the apparatus. A conventional floor jack includes a lifting plate pivotally interconnected to the second end of the lifting arm, and the lifting mechanism typically includes a secondary lever arm also pivotally interconnected to the lifting plate to maintain the plate in a generally horizontal orientation as the lifting mechanism moves the plate up and down in response to extension and retraction of the hydraulic piston. If a floor jack is used in constructing the apparatus of the invention the lifting plate is removed and lifting arm 23 is connected to the floor jack lifting mechanism. In modifying the floor jack it is more expedient to leave the secondary lever in place and pivotally connect the lifting arm to both lever arm 19 and the secondary lever arm. In this embodiment the lifting arm is formed as a generally L-shaped member with the first end 24 at the outer end of the short leg. A reinforcing plate 26 may be connected between the short and long legs of the L-shaped member. The specific shape of the lifting arm is not critical to the scope of the invention, and any desired configuration may be used so long as the lifting arm is firmly connected to the lever arm and extends outwardly beyond the front end of the body of the apparatus.

Figure 4:
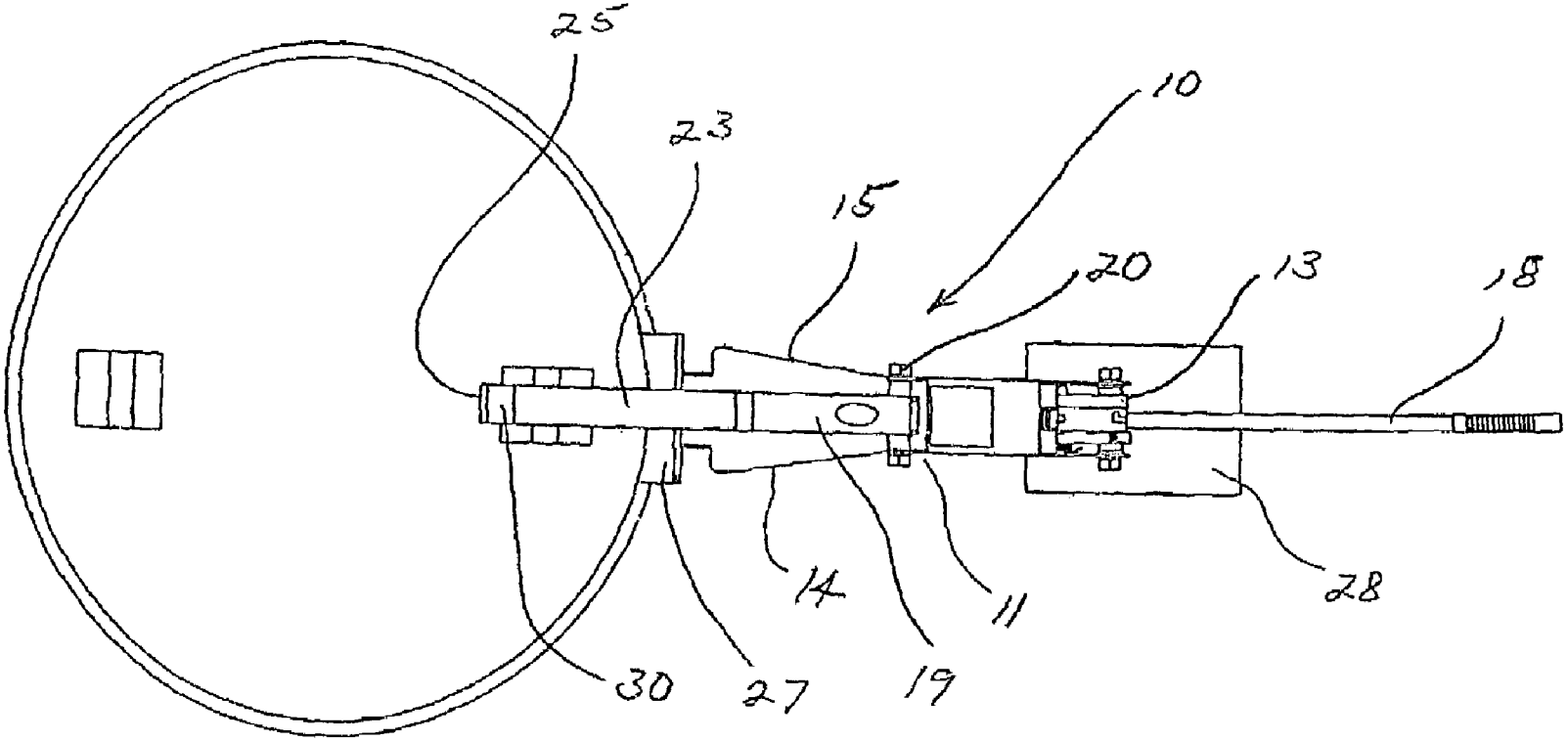
FIG. 4 is a top plan view of a preferred embodiment of the apparatus of the invention in place with a manhole cover and ring in preparation for use.
Figure 5:
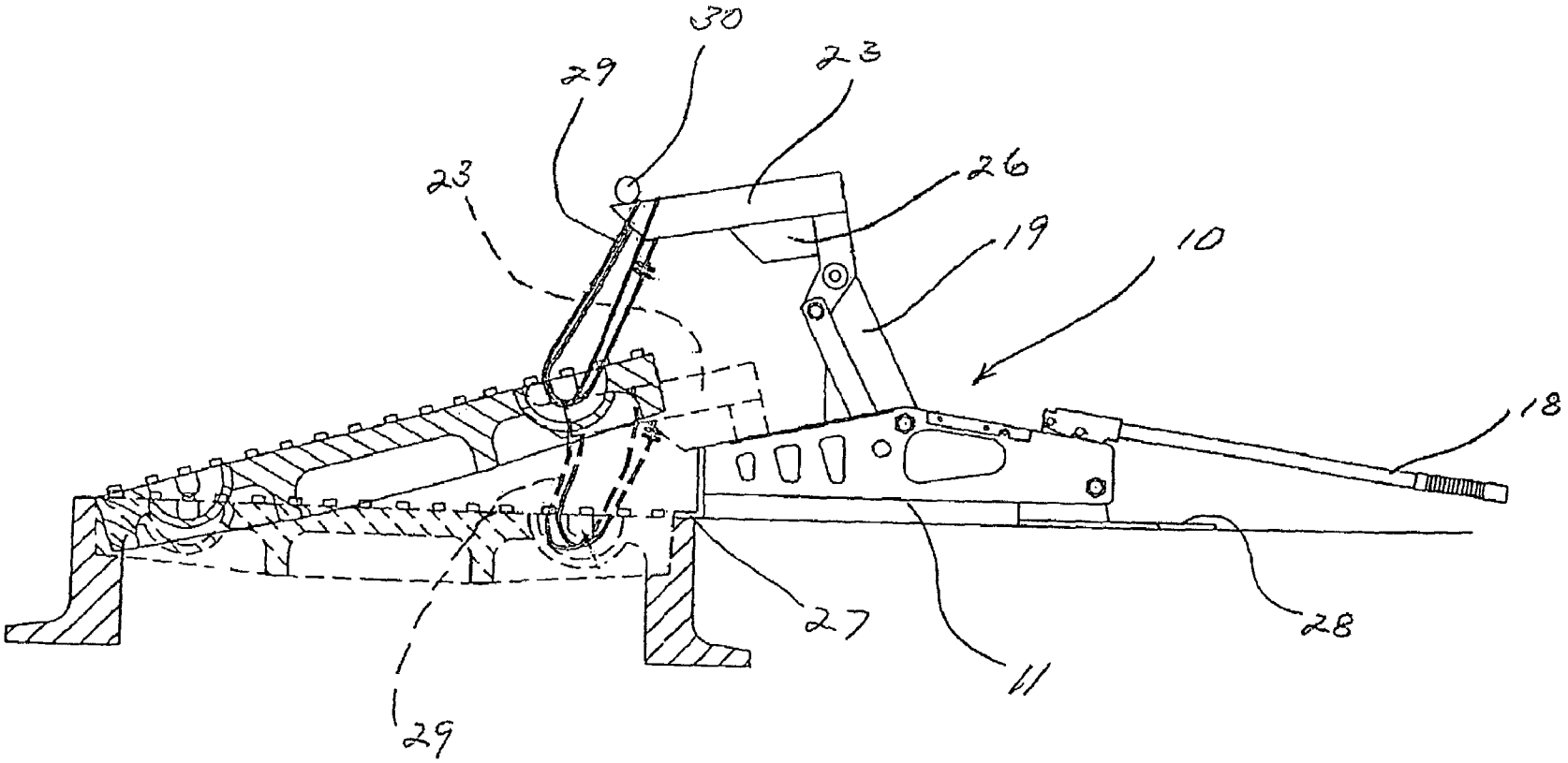
FIG. 5 is a side elevation view of a preferred embodiment of the device of the invention in place with a manhole cover and ring, showing in dashed lines the configuration of the apparatus and the position of the manhole cover prior to lifting, and showing in solid lines the configuration of the apparatus and the position of the manhole cover after removal from the ring.
Figure 6:
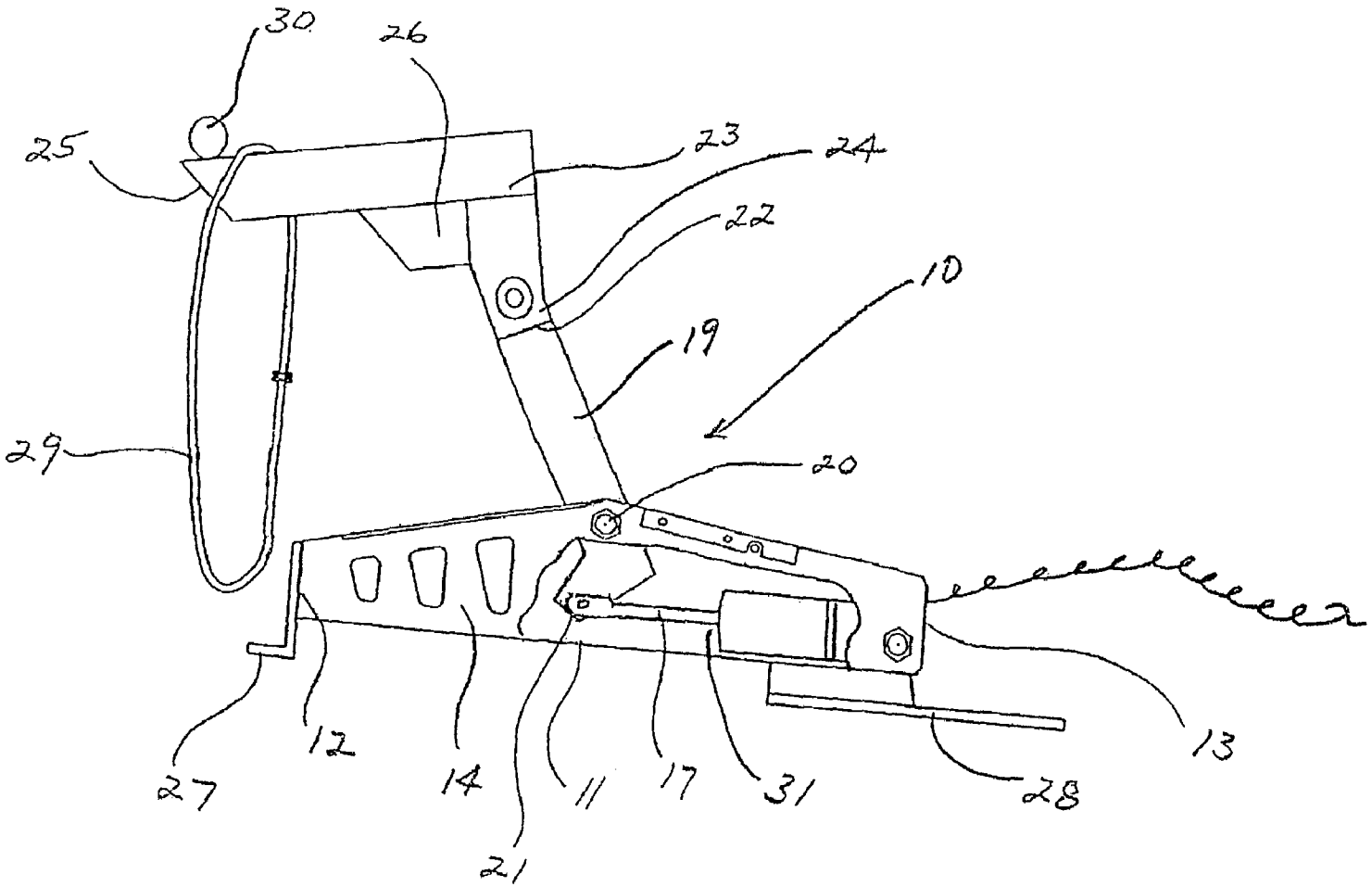
FIG. 6 is a side elevation view of an alternative embodiment, utilizing a motor driven hydraulic actuating assembly.
Figure 7:
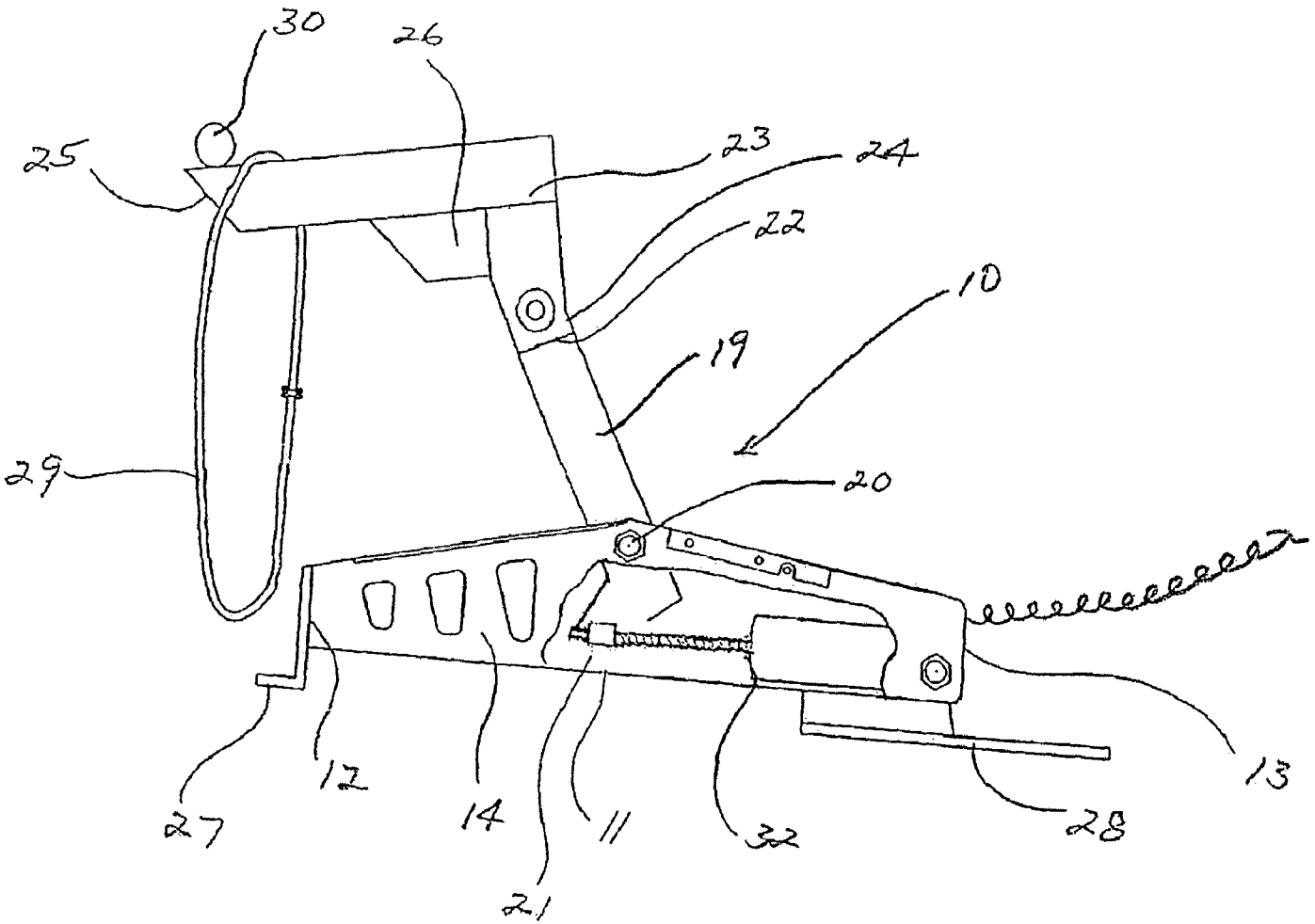
FIG. 7 is a side elevation view of an second alternative embodiment, utilizing a motor driven screw drive actuating assembly.

A ring engagement plate 27 is connected to the first end of body 11 and extends outwardly from below the body. A foot plate 28 is connected to the second end of body 11 and extends outwardly to the rear from below the body, so that the body of the apparatus will rest upon the ring engagement plate and the foot plate when the apparatus is placed flat upon a surface for use. The outward extension of the foot plate, and the area of the foot plate in contact with the ground is greater than that of the ring engagement plate. As shown in FIGS. 2, 3, and 5, it is preferred that the ring engagement plate and the foot plate extend downward a short distance from the body of the apparatus so that the body is supported above the ground or other surface. The downward extension of, especially, the ring engagement plate facilitates direct placement of the ring engagement plate on a mounting ring that is recessed below the surrounding ground or paving surface. The outer edge of the ring engagement plate 27 is crescent shaped as illustrated in FIG. 4, to generally match the curvature of a manhole cover mounting ring.

The apparatus of the invention is used by positioning the apparatus adjacent to a manhole with the longitudinal axis of the body of the apparatus generally aligned with a diameter line of the manhole cover, and with the second, outer end of lifting arm 23 disposed over a manhole cover lifting rod, and with ring engagement plate 27 disposed over and resting upon the manhole mounting ring. The ring engagement plate should be positioned to overlie the mounting ring without extending over the manhole cover. With lever arm 19 and lifting arm 23 in a lowered position a looped lifting cable 29 is extended under the manhole cover lifting bar and over second end 25 of the lifting arm, as illustrated in FIG. 5. A retaining knob 30 is connected to lifting arm 23 adjacent to its outer end 25 and the lifting cable loops are placed behind the retaining knob to prevent them from sliding off the end of the lifting arm. It is to be understood that the scope of the invention is not limited to the use of the specific lifting cable described above and shown in the drawing figures, and that any suitable means of engaging a manhole cover and temporarily connecting the manhole cover to the outer end of the lifting arm may be used. As non-limiting examples, such alternative means may include a length of cable with hooks at both ends, a loop of chain, a chain with hooks, and a rigid rod with hooks or other engagement means at each end. Similarly, the scope of the invention is not limited to the specific configuration of the retaining knob described and shown in the drawings, and it will be understood that other types of retaining means may be used to serve the same purpose. If a manhole is formed with, e.g., a key slot rather than a lifting bar, a key device may be engaged through the slot and connected to the lifting arm by the lifting cable or other selected means.

With the apparatus in place and engaged with the manhole cover, the hydraulic cylinder is actuated to extend the piston and raise the lever arm and lifting arm. When slack is removed from the lifting cable, or other engaging means, further actuation of the hydraulic cylinder applies a lifting force between the manhole cover and the mounting ring, acting to separate the manhole cover from the mounting ring. Since the force is applied between the manhole cover and the mounting ring, no net force is applied between the mounting ring and the surrounding surface and the ring itself is held firmly against the underlying structure supporting it, resulting in separation of the manhole cover from the ring rather than separation of the cover and ring from the supporting structure regardless of adhesion between the manhole cover and the ring. During actuation of the hydraulic cylinder, a user may place his foot on the foot plate extending outwardly from the rear of the body of the apparatus and apply downward pressure as needed to prevent that end of the apparatus from lifting from the ground. When the manhole cover has been broken loose from the mounting ring and raised above the ring, the cover can be readily moved aside for access to the manhole.

The apparatus of the invention is positioned to one side of the cover and mounting ring, and extends only partially over the cover. This allows the apparatus of the invention to be readily and effectively used to engage and lift a cover that is positioned immediately adjacent to an obstruction such as a wall, fence, or high curb. The apparatus of the invention may also be effectively used to lift a cover positioned in a corner formed by, e.g., intersecting walls or curbs.

In addition to the preferred embodiments described above and shown in the accompanying drawings, the apparatus is susceptible to various alternative embodiments within the scope of the invention. As an alternative to the use of a manually activated hydraulic cylinder and piston assembly, a motor driven hydraulic assembly 31 may be utilized, driven by, e.g., an electric motor powered from a vehicle electrical system. In another alternative embodiment a screw drive actuator 32 could be used to raise and lower the lever arm and lifting arm, driven manually or by an electric motor powered from a vehicle electrical system.

The foregoing description and accompanying illustration of preferred and alternative embodiments of the apparatus of the invention is intended to be illustrative and not limiting. Further alternative embodiments and variations are encompassed within the scope of the invention and within the scope of the following claims.

The invention claimed is:

1. A lifting apparatus for lifting a manhole cover from a cover mounting ring installed in a generally planar surface, the cover mounting ring having an upper edge surrounding the outer edge of the manhole cover, comprising, a body to be placed on the generally planar surface adjacent to the cover mounting ring and manhole cover to be lifted, said body having a longitudinal axis, a first end and a second end, a first side and a second side, each of said sides having an upper edge and a lower edge, said first and second sides extending in spaced apart parallel relation between said first end and said second end parallel to said longitudinal axis;

a ring engagement plate to be received on the upper edge of the cover mounting ring without extending over the manhole cover, said ring engagement plate extending outwardly from said second end of said body in perpendicular relation to said first and second sides, with said ring engagement plate disposed below said lower edges of said first and second sides;

an elongate lever arm having a longitudinal axis, a first end, and a second end, said lever arm pivotally connected between said first and second ends between said first and second sides of said body with said longitudinal axis of said lever arm and said longitudinal axis of said body in the same plane, with said first end of said lever arm between the point at which said lever arm is pivotally connected and said first end of said body, with said second end of said lever arm between the point at which said lever arm is pivotally connected and said second end of said body;

an elongate lifting arm having a longitudinal axis, a first end, and a second end, said lifting arm connected at said first end to said second end of said lever arm, such that the fulcrum at which said lever arm and said connected lifting arm rotates is at said pivotal connection of said lever arm to said body, with said longitudinal axis of said lifting arm and said longitudinal axis of said lever arm in the same plane, said lifting arm extending outwardly beyond said second end of said body and cantilevered from said body so as to extend partially over the manhole cover;

manhole cover engaging means for forming a releaseable connection between a manhole cover and said lifting arm adjacent to said second end of said lifting arm; and actuator means connected between said body and said first end of said lever arm for rotating said lever arm about said pivotal connection between said lever arm and said sides of said body so as to raise said lifting arm relative to said body, thereby separating and lifting the manhole cover from the cover mounting ring upon activation of said actuator means.

2. The lifting apparatus of claim 1, wherein said actuator means comprises a hydraulic cylinder and piston assembly having a cylinder and a piston moveable relative to said cylinder, with said cylinder connected to said body and with said piston connected to said first end of said lever arm.

3. The lifting apparatus of claim 2, wherein said hydraulic cylinder and piston assembly is manually activated.

4. The lifting apparatus of claim 2, wherein said hydraulic cylinder and piston assembly is activated by an electric motor.

5. The lifting apparatus of claim 1, wherein said actuator means comprises an electric motor.

6. The lifting apparatus of claim 1, wherein said body further includes a foot plate extending outwardly from said first end of said body in parallel relation with said ring engagement plate.

7. The lifting apparatus of claim 1, wherein said manhole cover engaging means comprises a looped cable, and wherein said lifting arm includes a cable retaining knob connected to and extending upwardly from said lifting arm adjacent to said second end thereof.

8. The lifting apparatus of claim 1, wherein said lifting arm is integrally formed with said lever arm.

9. The lifting apparatus of claim 1, wherein said ring engagement plate has an outer edge, and wherein said outer edge of said ring engagement plate is formed with a concave curvature.

10. The lifting apparatus of claim 1, wherein said body, said lever arm, and said actuator means are components of a conventional floor jack.

11. A modification of a conventional floor jack for use as a manhole cover lifting apparatus for the purpose of separating and lifting a cover from an annular cover mounting ring surrounding and supporting the cover, the floor jack having a body with first and second ends and with a base for supporting the body upon a horizontal surface, a lever arm with first and second ends pivotally connected between the first and second ends of the lever arm to the body between the first and second ends of the body, an actuator means connected to the body and connected to the first end of the lever arm for rotating the lever arm around the pivotal connection of the lever arm to the body so as to raise and lower the second end of the lever arm relative to the body, and a lifting plate connected to the second end of the lever arm to be raised and lowered with the lever arm, the modification comprising, an elongate lifting arm having a first end and a second end, said lifting arm rigidly connected at said first end to the second end of the lever arm in place of the lifting plate, with said lifting arm cantilevered outwardly beyond the second end of the body;

cover engaging means for forming a releaseable connection between said second end of said lifting arm and the cover; and a ring engagement plate with a first end and a second end, said ring engagement plate connected to and extending outwardly from the base of the body at the second end of the body, said second end of said ring engagement plate to be received on the cover mounting ring without extending over the cover supported by the cover mounting ring.

12. The modification of claim 11, further comprising a foot plate connected to and extending outwardly from the base of the body at the second end of the body parallel to said ring engagement plate.

13. The modification of claim 11, wherein said ring engagement plate has an outer edge at said second end thereof, and wherein said outer edge is curved to match the curvature of the annular cover mounting ring.

14. The modification of claim 11, wherein said cover engaging means comprises a loop of cable extending through an aperture in the cover and said second end of said lifting arm.

15. The modification of claim 14, wherein said lifting arm includes a cable retainer connected to said second end of said lifting arm.

16. The modification of claim 11, wherein said cover engaging means comprises a rod with a first end and a second end, said rod pivotally connected at said first end thereof to said second end of said lifting arm, and said rod releasably connectable at said second end thereof to the cover.

17. A method of separating and lifting a cover from an annular cover mounting ring surrounding and supporting the cover over an opening in a generally horizontal surface in which the cover mounting ring is disposed, using a cover lifting apparatus having a body with first and second ends, a lifting arm connected to the body with the outer end of the lifting arm cantilevered outwardly from the second end of the body, an actuating means for raising and lowering the outer end of the lifting arm relative to the body, a ring engagement plate connected to and extending outwardly from the second end of the body below the outward extension of the lifting arm, and cover engaging means releasably connectable between the outer end of the lifting arm and the cover, comprising the steps of, placing the lifting apparatus with the second end of the body of the apparatus adjacent to the cover and cover mounting ring, with the ring engagement plate at the second end of the body received on the cover mounting ring without extending over the cover and the first end of the body resting on the generally horizontal surface, and with the cantilevered lifting arm lowered relative to the body and extending partially over the cover;

connecting the cover engaging means between the outer end of the cantilevered lifting arm and the cover; and activating the actuating means to raise the outer end of the cantilevered lifting arm relative to the ring engagement plate connected to the body of the lifting apparatus, thereby applying lifting force between the cover and the cover mounting ring through the cover lifting apparatus without applying lifting force between the cover mounting ring and the generally horizontal surface in which the cover mounting ring is disposed.

18. The method of claim 17, comprising the further step of continuing activation of the actuating means until the cover is separated and lifted from the cover mounting ring.

19. The method of claim 17, comprising the additional step of holding the first end of the body of the cover lifting apparatus against the generally horizontal surface during activation of the actuating means, to prevent the body from lifting from the generally horizontal surface.

* * * * *